US008151909B2

(12) United States Patent
Küttel et al.

(10) Patent No.: US 8,151,909 B2
(45) Date of Patent: Apr. 10, 2012

(54) MODULAR TOP DRIVE LUBRICATION SYSTEM AND METHODS

(75) Inventors: Beat Küttel, Spring, TX (US); Randall S. Pyrch, Montgomery, TX (US); Faisal J. Yousef, Houston, TX (US); Alan S. Richardson, The Woodlands, TX (US); Greg Kostiuk, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 12/903,764

(22) Filed: Oct. 13, 2010

(65) Prior Publication Data

US 2011/0073375 A1 Mar. 31, 2011

Related U.S. Application Data

(63) Continuation of application No. 11/613,685, filed on Dec. 20, 2006, now Pat. No. 7,828,085.

(60) Provisional application No. 60/752,116, filed on Dec. 20, 2005.

(51) Int. Cl.
*E21B 19/00* (2006.01)

(52) U.S. Cl. ..... 175/162; 175/87; 175/203; 166/77.52

(58) Field of Classification Search ..... 166/77.51; 175/162, 203, 87

See application file for complete search history.

(56) References Cited

U.S. PATENT DOCUMENTS

| | | | | |
|---|---|---|---|---|
| 2,937,008 | A | 5/1960 | Whittle | |
| 4,813,493 | A | 3/1989 | Shaw et al. | |
| 4,899,959 | A | 2/1990 | Weiler | |
| 5,921,329 | A | 7/1999 | Armstrong | |
| 6,561,155 | B1 | 5/2003 | Williams | |
| 6,725,949 | B2 | 4/2004 | Seneviratne | |
| 7,270,189 | B2 | 9/2007 | Brown et al. | |
| 7,401,664 | B2 | 7/2008 | Wells et al. | |
| 7,500,531 | B2 | 3/2009 | Williams et al. | |
| 7,673,675 | B2 | 3/2010 | Carr et al. | |
| 7,743,853 | B2 | 6/2010 | Rudshaug et al. | |
| 7,748,473 | B2 | 7/2010 | Wells et al. | |
| 2005/0279507 | A1 * | 12/2005 | Folk et al. | 166/378 |
| 2006/0096751 | A1 | 5/2006 | Brown et al. | |
| 2007/0039758 | A1 | 2/2007 | Klipstein | |
| 2007/0140801 | A1 | 6/2007 | Kuttel et al. | |
| 2007/0209878 | A1 | 9/2007 | Czechowski et al. | |
| 2007/0240908 | A1 | 10/2007 | Brown et al. | |

OTHER PUBLICATIONS

ISA/US, International Search Report and Written Opinion of the International Searching Authority, PCT/US2006/62414, mailed Oct. 15, 2007.

WIPO, International Preliminary Report on Patentability, PCT/US2006/62414, issued Jun. 24, 2008.

* cited by examiner

*Primary Examiner* — Giovanna Wright

(74) *Attorney, Agent, or Firm* — Haynes and Boone, LLP

(57) ABSTRACT

A top drive system with a plurality of top drive modules, which are configured to be quickly exchanged. The top drive modules may include any or all of the following: a main body module, a gearbox module, a drive motor module, a pipe handler module, an upper fluid module, a lower well control valve module, a block interface module, a retract system interface frame module, a cooling system module, a work platform guard module, and a quill saver sub module. Alternatively, the top drive may comprise a first top drive and a second top drive which are configured to be quickly exchanged.

21 Claims, 4 Drawing Sheets

MODULAR TOP DRIVE LUBRICATION SYSTEM AND METHODS

CROSS-REFERENCE TO RELATED APPLICATIONS

This application is a continuation of U.S. patent application Ser. No. 11/613,685 filed Dec. 20, 2006 now U.S. Pat. No. 7,828,085, now allowed, which claims the benefit of U.S. Application No. 60/752,116, filed Dec. 20, 2005, the contents of each of which are hereby incorporated herein by express reference thereto.

BACKGROUND OF THE INVENTION

Increasingly, drilling contractors are using top drives instead of Kellies or Kelly bushings. A top drive is a drilling tool that hangs from the traveling block, and has one or more motors to power a drive shaft to which crewmembers attach the drill string. Because the top drive's motor can rotate the drill string, no Kelly or Kelly bushing is required. The top drive also incorporates a spinning capability and a torque wrench. In addition the top drive has elevators on links. The benefits of top drives may include the ability to work in 90 feet increments rather than the 30 feet increments to which a Kelly is typically limited. That is, a joint of tubular is typically 30 feet long. Thus, a top drive allows an operator to work with 3 joints of tubular per increment of a given operation. For example, top drives allow operators to assemble three-joint (90 feet) stands of tubular off the critical path to save time. Similarly, in some instances, such as, for example, applications involving horizontal or highly deviated well bores, it may be desirable to remove tubular from a well bore by a process known as back reaming. A top drive allows operators to back ream tubular from a well bore in three joint stands of tubular, which may then be racked intact.

On a drilling rig, the critical path includes all tasks and equipment required to continue drilling without interruption. When a task or equipment on the critical path is delayed, the entire drilling operation is delayed. Thus, because mechanical devices require some amount of repair and/or maintenance, many drilling rig critical path components are maintained in redundant quantities to decrease downtime caused by inevitable repair and maintenance. Conventionally, top drives have been an exception to this principle of redundancy. Because top drives are generally on the critical path, top drives create the potential for single point failure—that is, if the top drive goes down, the entire drilling operation stalls, rendering the entire rig nonoperational until the top drive can be brought back online Generally, diagnostics occur in the critical path before any repairs can be done, causing additional delay in the operation before repair even begins. Likewise, maintenance operations can fall within the critical path, creating downtime.

SUMMARY OF THE INVENTION

The present invention relates to the field of oil or gas well drilling and more particularly to a method and apparatus for drilling a well and handling tubulars.

According to one aspect of the invention, there is provided a top drive system comprising: a first top drive; and a second top drive, wherein the first and second top drives are configured to be quickly exchanged.

A further aspect of the invention provides a top drive system comprising: a plurality of modules; wherein the modules are configured to be quickly exchanged.

Yet another aspect of the invention provides a method of increasing drilling efficiency comprising: providing a first top drive module on a critical path; providing a second top drive module off the critical path; replacing the first top drive module with the second top drive module such that the second top drive module is on the critical path and the first top drive module is off the critical path.

The invention further encompasses a top drive system including a top drive, a gearbox module fluidly coupled to a gearbox lubrication system of the top drive system, and at least one bearing adapted for lubrication by a bearing lubrication system fluidly coupled to the at least one bearing, wherein the bearing lubrication system is separate from at least the gearbox lubrication system so as to prevent any wear debris in the gearbox and gearbox lubrication system from interacting with the at least one bearing and the bearing lubrication system. In one embodiment, the bearing lubrication system is adapted to convectively circulate lubricant. In another embodiment, the bearing lubrication system convectively circulates lubricant in the absence of forced circulation. In a preferred embodiment, the bearing lubrication system is adapted to naturally convectively circulate lubricant.

In one embodiment, the gearbox lubrication system includes a filter. In another embodiment, the gearbox lubrication system is adapted to circulate via a pumping system. In yet another embodiment, the gearbox module is adapted to be quickly replaced with a replacement gearbox module that is off a critical path. In a preferred embodiment, the gearbox module is configured to connect to the top drive through a splined connection and one or more fasteners. In yet another embodiment, the gearbox module includes one or more of the following: a one-speed gearbox; a multi-speed gearbox; one or more input shafts for each of one or more coupled drive motors; one or more torque keys or quick latch assemblies to facilitate rapid removal and installation; and a splined bull gear to transmit torque to the spindle. In a preferred embodiment, the one-speed gearbox has a reduction ratio range from about 6.89:1 to 9:1. In yet a further embodiment, the gearbox lubrication system includes at least one of the following: a dry sump reservoir; a suction strainer; one or more screw pumps and one or more electric motors; one or more filters; a distribution manifold; a sensor for sensing oil pressure; and a lube oil cooler.

The invention further encompasses a top drive system, including: a top drive including at least one bearing, and a bearing lubrication system fluidly coupled to the at least one bearing, wherein the bearing lubrication system is adapted to lubricate the at least one bearing through convective circulation and gravity in the absence of forced circulation. In another embodiment, the bearing lubrication system is further adapted to circulate unfiltered lubrication. In yet a further embodiment, the bearing lubrication system is fluidly isolated from any other lubrication system associated with the top drive.

The invention additionally encompasses methods for minimizing bearing replacement in a top drive by convectively circulating filtered lubricant in at least a gearbox module of the top drive to provide lubrication thereto, and separately convectively circulating a second lubricant in association with at least one bearing in the top drive, whereby the filtered lubricant and the second lubricant are isolated to minimize contact between wear debris from any module including at least the gearbox module and the at least one bearing. In one embodiment, the second lubricant is the same as the first lubricant. In a preferred embodiment, the second lubricant is naturally convectively circulated.

Further, the invention encompasses a top drive system including a top drive, and a retract system interface frame module which includes a connection configuration adapted to mate with a variety of retract systems so as to make the retract system interface frame module quickly interchangeable with an off critical path replacement retract system interface frame module. In one embodiment, the retract system interface frame module includes at least one of an auto lubrication system, a junction box, a cooling system module, blowers for motor cooling, a programmable logic control, or a lubrication filtration system. In another embodiment, the retract system interface frame module is configured to move away from a second module of the top drive to facilitate rapid access to the second module. In yet a further embodiment, the retract system interface frame module rotates away from the second module. In still another embodiment, the retract system interface frame module includes a connection configuration in association with a plurality of guides to facilitate rapid interchange of a pair of one or more alternate top drive modules associated with the top drive.

It should be understood that each of the embodiments herein may be used alternatively or additively, as may be appropriate.

BRIEF DESCRIPTION OF THE DRAWINGS

The present invention may be better understood by reading the following description of non-limitative embodiments with reference to the attached drawings wherein like parts of each of the several figures are identified by the same referenced characters, and which are briefly described as follows.

DETAILED DESCRIPTION OF THE PREFERRED EMBODIMENTS

Figure 1:
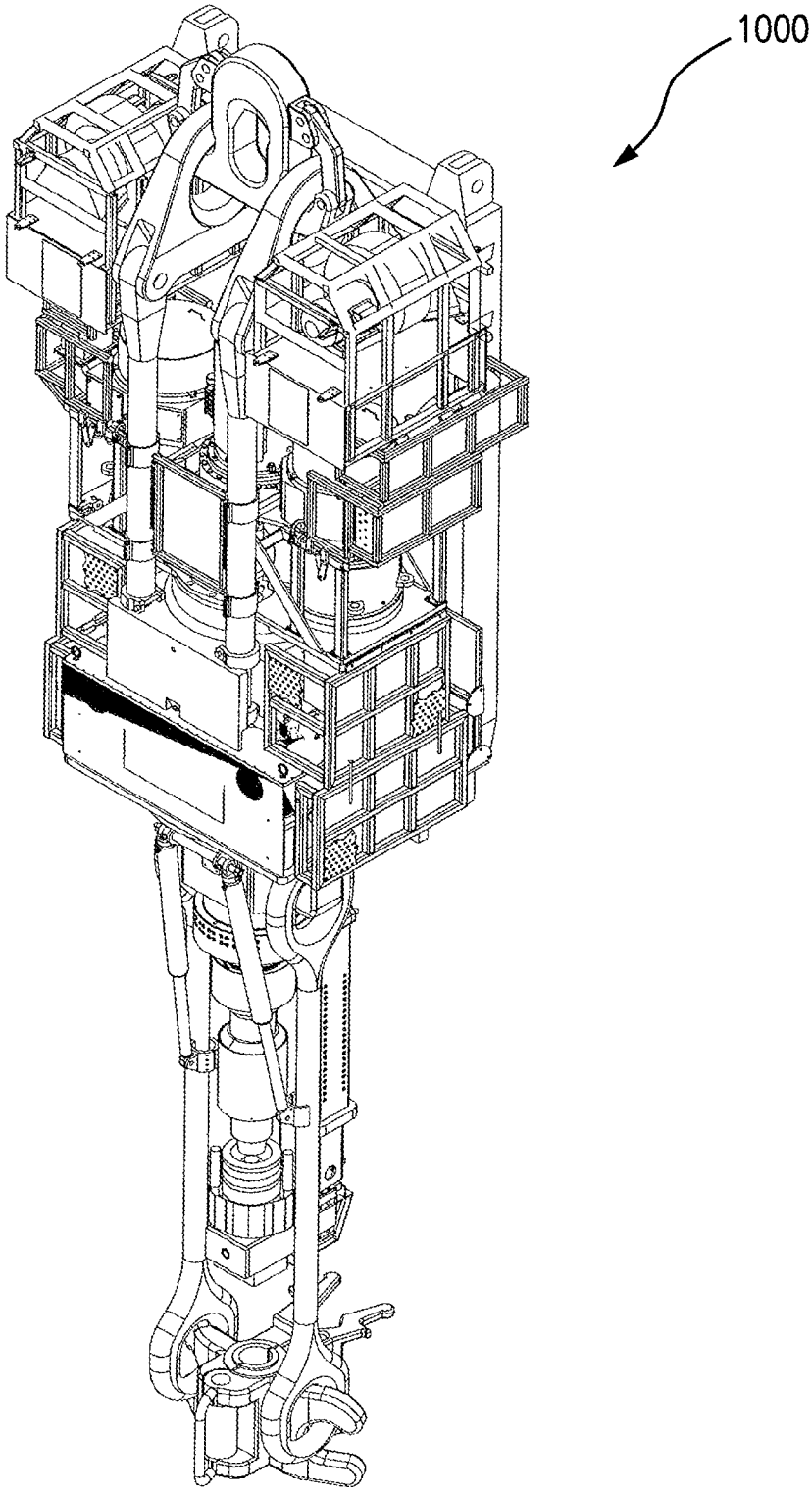
FIG. 1 is a perspective view of an embodiment of the top drive system having the following top drive modules: a main body, a gearbox, two drive motor modules, a pipe handler, an upper fluid module, a lower well control valve, a block interface, two work platform guard modules, two cooling system modules, a quill saver sub module, and a retract system interface frame module.
Figure 2:
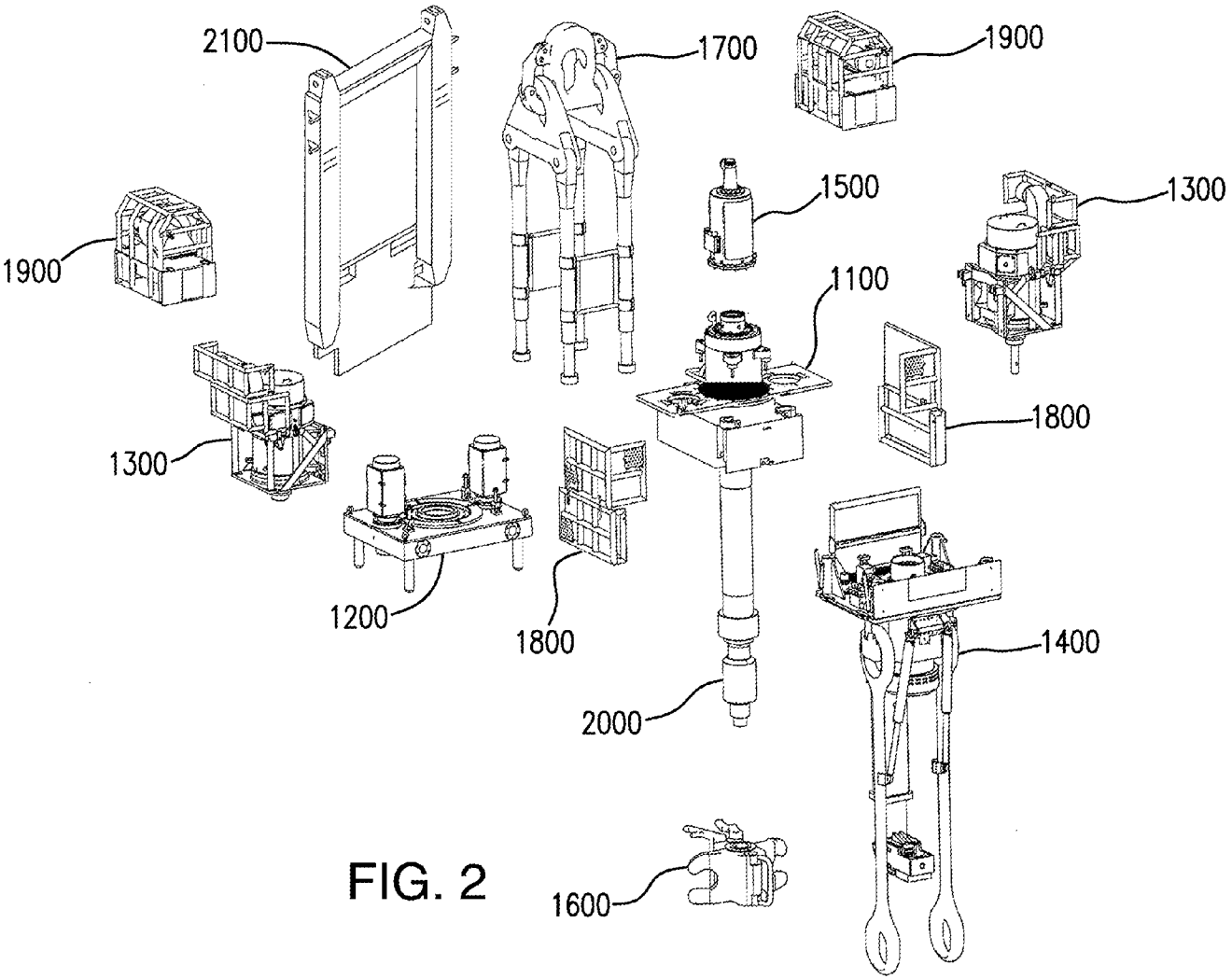
FIG. 2 is an exploded view of an embodiment of the top drive system of FIG. 1.

The present invention relates to the field of oil or gas well drilling and more particularly to a method and apparatus for drilling a well and handling tubulars. Referring now to FIG. 1, according to one embodiment of the invention, a top drive system 1000 is provided having a number of top drive modules. Referring now to FIG. 2, in a particular embodiment, the top drive modules may include one or any number of the following: a main body module 1100, a gearbox module 1200, two drive motor modules 1300, a pipe handler module 1400, an upper fluid module 1500, a lower well control valve module 1600, a block interface module 1700, two work platform guard modules 1800, two cooling system modules 1900, a quill saver sub module 2000, and a retract system interface frame module 2100. Each of these modules may have components and features as listed below.

When it becomes necessary to perform maintenance on a particular component of a modular top drive system of the present invention, for example top drive system 1000, due to failure or routine maintenance, a top drive module containing that component may be quickly replaced with a corresponding top drive module that is already in proper working order. This allows operations to continue without significant interruption. As operations continue, maintenance and/or repairs can be performed on the component off the critical path, such that the top drive module that was removed can be used when the need arises. Alternatively, the entire top drive module may be sent off site for repair or the top drive module may be disposed of.

A further aspect of a modular top drive of the present invention is the ability for dual activities to occur simultaneously. By way of example, and not of limitation, the replacement of a drive motor on a conventional top drive is a lengthy process due to the serial nature of the replacement steps. That is, the electrician may need to disconnect the drive motors electrical connections before the mechanic may remove the drive motor. Then the mechanic may align and install the replacement drive motor. Then the electrician may make the electric connections to the new drive motor. Conversely, a modular top drive of the present invention may be assembled such that the electrical connections are physically located far enough away from the mechanical connections such that the electrician and the mechanic may perform their tasks in parallel, that is, at the same time or nearly the same time, hence reducing downtime.

Interchangeable top drive modules may also be desirable for reasons beyond maintenance or repair. For instance, different top drive modules may be used for different drilling and/or make-up configurations. In certain drilling applications, different drill speeds may be required. Rather than using a variable or multi-speed gearbox, the different speeds may be provided by exchanging gearbox modules with different single speed gear arrangements that are simpler and more reliable. Similarly, different tubular diameters may be accommodated by exchanging lower well control valve modules. Similarly, different drive motor modules may be better suited to different applications such as coring, drilling, and workover. Other advantages of different modular configurations will be apparent, with the benefit of this disclosure, to a person of ordinary skill in the art.

Depending on the specific top drive system 1000 and the specific conditions, there may be any number of top drive modules. For example, a single top drive module may be used. In this example, the top drive module may include the entire top drive system 1000, and be interchangeable with another complete top drive system module 1000. This configuration requires no diagnostics to determine which component is problematic until the top drive system 1000 is off-line. Similarly, a short module replacement time simplifies the repair or replace decision-making process such that a module may be quickly replaced and diagnostics conducted on the replaced module off the critical path. If replacing the entire top drive system 1000 is not practical, or is otherwise not desired, multiple top drive modules may be used. The components of the top drive system 1000 may be grouped into modules in any number of ways, and the configuration of the individual modules should not be limited by the specific embodiment(s) discussed below.

The top drive modules of a modular top drive system of the present invention may be coupled according to a variety of techniques, so long as the techniques allow for quick change capability of the modules of a modular top drive. Additionally, it is desirable that the connections readily allow for the exchange of one top drive module for a similar top drive module. Furthermore, it may be desirable for the connection mechanisms to allow for vertically lifting and lowering of the top drive modules as they are connected and disconnected to a modular top drive system. Suitable connection techniques include, but are not limited to, a multi-unit retract system, bolts, inserts and pins, dovetail slide-ons, eccentric jam devices, keyway slots, pilot rings and clamps, splined connections, split rings, guide pins, torque arrest mechanisms, O-ring seals, flanges, pins and slots, and any combination thereof. Additionally, a person of ordinary skill in the art will be aware, with the benefit of this disclosure, of other techniques for coupling the modules of a modular top drive system In one exemplary embodiment, shown in FIG. 2, a top drive system 100 may have a main body module 1100, a gearbox module 1200, two drive motor modules 1300, a pipe handler module 1400, an upper fluid module 1500, a lower well control valve module 1600, a block interface module 1700, two work platform guard modules 1800, two cooling system modules 1900, a quill saver sub 2000, and a retract system interface frame module 2100.

The main body module 1100 may serve as a base, and other top drive modules or components may be attached to the main body module 1100, either directly or indirectly, using one or more of the connection techniques described above. The main body module 1100 may have any or all of the following: a top drive housing with mounts for a block interface module 1700; main bearings; a hollow spindle, which may be splined for connection to gearbox module 1200; a floating quill, which may have 8 inch free float travel and a male spline connection; an upper bearing carrier with motor mounts; a retract system interface frame with blowers for motor cooling; and an auto grease system. Some embodiments may have a self contained splash lubrication system that is itself modular. Similarly, some embodiments, for example top drive system 1000, may have a retract system interface frame that is itself modular. The main body module 1100 may additionally or alternatively include any other components that would typically remain intact when changing out other top drive modules.

The gearbox module 1200 may be quickly attached to, or detached from, the main body module 1100 using one or more of the connection techniques described above. For example, the connection may be via a spline and pins that act as a gravity retention as well as a torque arresting mechanism. This allows the gearbox module 1200 to be completely removed and replaced with another gearbox module 1200, allowing for repair of any components therein off the critical path. The gearbox module 1200 may have any or all of the following: a simple one speed gearbox, which may have a reduction ratio between about 6.890 to 1 and 9.000 to 1; input shafts for one or more coupled drive motors; one or more couplings with guard and drive shaft; inspection view windows; one or more torque keys and quick latch assemblies for easy removal and installation; a splined bull gear to transmit torque to the spindle; and a self-contained gearbox lubrication system. The self-contained gearbox lubrication system may include the following: a dry sump reservoir; a suction strainer; one or more screw pumps and one or more electric motors; one or more filters with visual indicators and remote sensors; a distribution manifold; a remote sensor for sensing oil pressure; and a lube oil cooler with an electric fan. In some embodiments, the gearbox module 1200 may include a multi speed gearbox. In other embodiments, a plurality of single speed gearboxes, which may be quickly interchangeable, may be more preferable than one or more multi-speed gearboxes for reasons of reliability. The gearbox module 1200 may additionally or alternatively include any other components that would typically be associated with the components of the gear system.

The drive motor module 1300 may be quickly attached to, or detached from the main body module 1100 using one or more of the connection techniques described above. This allows the drive motor module 1300 to be completely removed and replaced with another drive motor module 1300. This allows for the repair of components of the drive motor module 1300 to take place off the critical path. The drive motor module 1300 may include one or more motors, such as AC electric motors, GE model GEB-20, 1150 HP; a motor module frame to allow quick installation and removal of the entire drive motor module 1300; a coupling to the gearbox module 1200 for quick alignment or isolation in the event of a failure; a brake system; a programmable logic controller ("PLC") junction box or simple electrical junction box for control and sensors; and a guard and lifting assembly. The brake system may include the following: five (5) disk brake calipers; hydraulic controls; and an auto bleed system. In some embodiments, it may be desirable to locate the electrical connections of drive motor module separate from the mechanical connections, so as to enable dual activities during replacement, maintenance, and/or repair. The drive motor module 1300 may additionally or alternatively include any other components that would typically be associated with the components of the motor system.

The pipe handler module 1400 may be quickly attached to, or detached from the main body module 1100 using one or more of the connection techniques described above. For example, the connection may be made via a slide-on module using split rings as the main connection method, along with guide pins which act as a locating guide and as a torque arrest method. This allows the pipe handler module 1400 to be completely removed and replaced with another pipe handler module 1400. This allows for the repair of components to take place off the critical path. The pipe handler module 1400 may include any or all of the following: a mounting plate; a rotary manifold for hydraulic and air communication; an elevator link support; an integrated link counter balance system; a link tilt assembly; a back-up wrench; a handling frame for ease of movement when removed; and an auto grease system. The mounting plate may include the following: hydraulic valve banks direct mounted to a porting plate to eliminate hoses and leak points; a redundant handler to rotate modules; a redundant handler to lock modules; dual PLC junction boxes with quick connects; and a fold down guard, which may double as a work platform. Some embodiments, for example top drive system 1000, may have one or more fold down guards that are themselves modular, for example, work platform guards 1800. The rotary manifold may include the following: twenty (20) passages with test ports and radial bearings for centralization. The link tilt assembly may have bi-directional hydraulic actuation and float capabilities. The back-up wrench may have quick change capability with driller controlled vertical positioning and include the following: a hydraulic gripper, with a capacity up to 11 inch diameter and 120,000 ft/lb torque; driller controlled vertical positioning; removable die blocks; and a pipe stabbing guide. The pipe handler module 1400 may additionally or alternatively include any other components that would typically be associated with the components of the pipe handling system.

The upper fluid module 1500 may be quickly attached to, or detached from the main body module 1100 using one or more of the connection techniques described above. For example, the bonnet may be bolted or pinned to the main body module via a spline and an O-ring seal connection. Alternatively, a clamp or flange and O-ring seal may be used. This allows the upper fluid module 1500 to be completely removed and replaced with another upper fluid module 1500. This allows for the repair of components to take place off the critical path. The upper fluid module 1500 may include a washpipe assembly with 7500 PSI WP, 4 inch bore; an upper sealing including a wiper, a flinger, a labyrinth seal, and lubrication oil seals for mud exclusion; and a mud line with top access 7500 PSI WP, 4 inch bore. The upper fluid module 1500 may additionally or alternatively include any other components that would typically be associated with the components of the fluid system.

The lower well control valve module 1600 may be quickly attached to, or detached from the main body module 1100 using one or more of the connection techniques described above. For example the connection may be made via the split ring connection of a quill saver sub module 2000. This allows the lower well control valve module 1600 to be completely removed and replaced with another lower well control valve module 1600. This allows for the repair of components to take place off the critical path. The lower well control valve module 1600 may include a splined quill saver sub, for example, quill saver sub module 2000, which may be splined for quick removal, allowing multiple quill connections to match a given drill string. Additionally, a splined quill saver sub, for example, quill saver sub module 2000, may accommodate future and unforeseen drill string connections. The saver sub may have a remote operated lower well control valve; a hydraulic valve actuator; two manual lower well control valves; and connection clamps. Examples and properties of quill saver subs are further disclosed in U.S. application Ser. No. 11/405,940, which is hereby incorporated by reference. The lower well control valve module 1600 may additionally or alternatively include any other components that would typically be associated with the components of the lower well control system.

The block interface module 1700 may be quickly attached to, or detached from the main body module 1100 using one or more of the connection techniques described above. For example, the connection may be made using a pin and slot connection or a split-ring connection. This allows for the repair or inspection of load path components to take place off the critical path. The block interface module 1700 may include four upper links; two link to bail adapters; a block adapter; and four load cell pins. The block interface module 1700 may additionally or alternatively include any other components that would typically be associated with the components of the block system. The block interface module 1700 may be exchanged for another block interface module, for example, when changing rigs.

The cooling system module 1900 may be quickly attached to, or detached from, one or more of the main body module 1100, the drive motor module 1300, and the retract system interface frame module 2100 using one or more of the connection techniques described above. This allows the cooling system module 1900 to be completely removed and replaced with another cooling system module 1900. This allows for the repair of components to take place off the critical path. In some embodiments, cooling system module 1900 may be hinged or other wise connected to a part of a modular top drive system, for example retract system interface frame module 2100, such that cooling system module 1900 may be rotated away from, for example, drive motor module 1300 to provide enhanced access to the same. The cooling system module 1900 may have one or more circulators, for example a blower and/or a pump, and one or more ducts. In some embodiments, the one or more circulators and the one or more ducts may themselves be modular. The cooling system module 1900 typically uses air to cool. However, any coolant may be used. The cooling system module 1900 may additionally or alternatively include any other components that would typically be associated with the component of the cooling system.

The retract system interface frame module 2100 may be particularly useful when interchanging an entire top drive system 1000. The retract system interface frame module 2100 may have a pin configuration that may interface to a plurality of guide dollies and/or retract systems, such that the retract interface frame module 2100 is interchangeable between derricks. The retract system interface frame module 2100 may contain an auto lube system. The retract system interface frame module 2100 may additionally or alternatively include other components, for example, junction boxes, cooling loops, PLCs, lube systems, filters for lube systems, and the like, to allow for dual activities when replacing the modules of a modular top drive system of the present invention. The retract system interface frame module 2100 may additionally or alternatively include any other components that would typically be associated with the components of the retract system interface frame system.

According to other embodiments of the invention, a modular top drive system of the present invention may be an interchangeable top drive system comprising dual top drive systems such as, for example, top drive system 1000. This enables the operators to trouble-shoot and/or configure the off-line top drive while the other top drive is in operation. The operators may change out a complete top drive. Each of the top drives may have permanently installed service loops. Each top drive may be preconfigured for different drilling and/or make-up configurations.

Another embodiment of the invention relates to different configurations of a modular top drive system. For example, in addition to the example embodiment top drive system 1000, another embodiment may be formed from the following top drive modules: dual coupled main drive motors, quick change IBOP (LWCV), pipe handler module 1400, gearbox module 1200, a lube system, and a back-up wrench. Furthermore, using the principles of modular construction of a top drive system discussed herein, a person of ordinary skill in the art will be aware of numerous additional modular constructions of top drive systems, comprising virtually any number of top drive modules, which may be suited to numerous drilling, casing, and any other tubular handling applications.

Some embodiments of the top drive system 1000 have a motor cooling system. In some embodiments, the cooling system may have modular components, for example, cooling system module 1900. The system may be a cooling system for the one or more main drive motors. It may also have ducts integrated with the top drive support structure, which may include modular or nonmodular frame and/or guard structures, such that the ducts are the interiors of hollow beams of the support structure. One or more circulators may be connected to the one or more motors through a manifold and/or duct system so that any of the one or more circulators may cool any and/or all of the one or more motors. The cooling system may circulate air, or any other coolant. This builds redundancy into the system.

Figure 3:
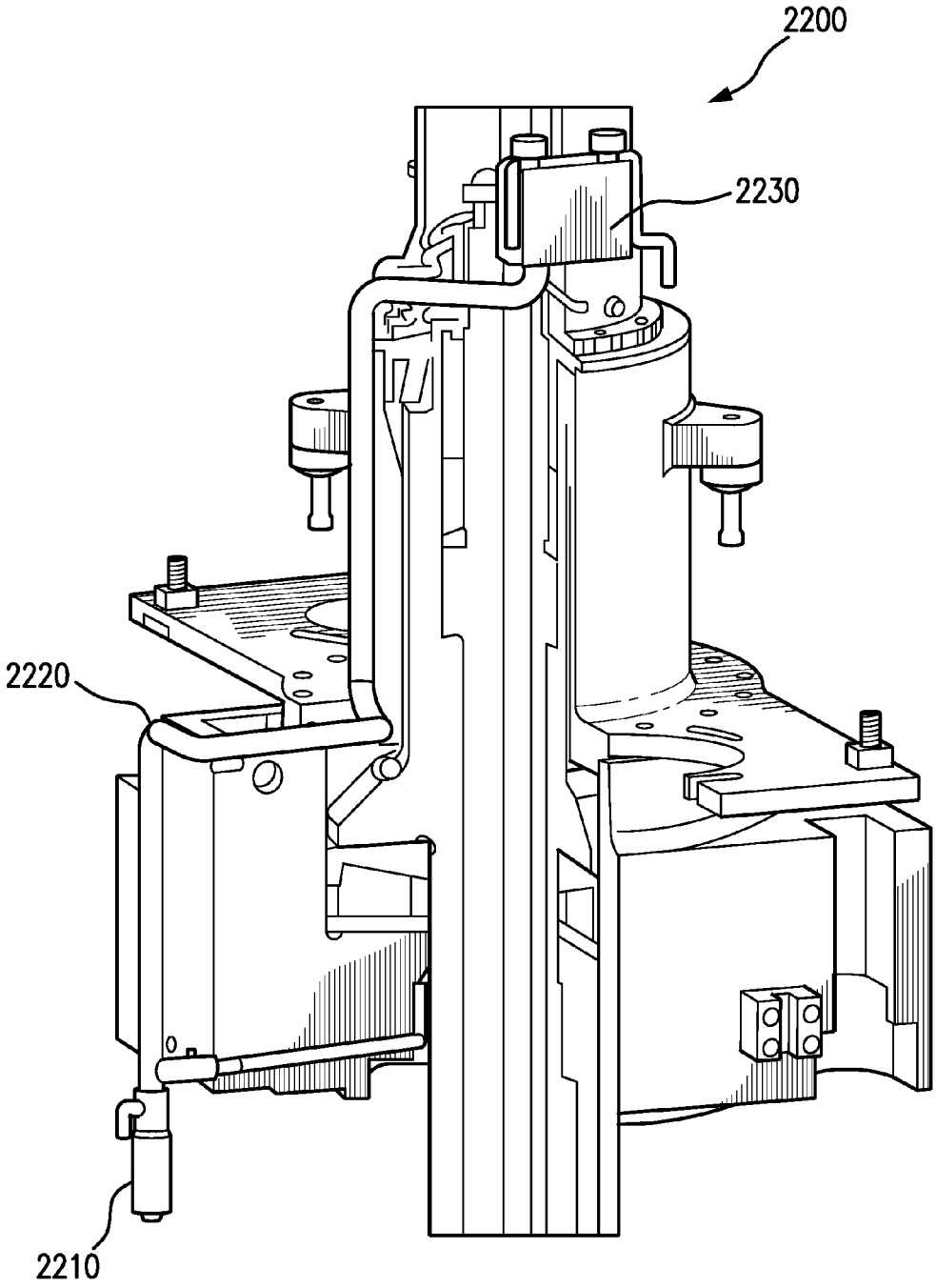
FIG. 3 is a partially cut away perspective view of one embodiment of a bearing lubrication system.

Embodiments such as, for example, top drive system 1000 may also have separate lubrication systems for the gearbox and the bearings. This prevents any wear debris from the gearbox from interacting with, and potentially damaging, the bearings. In the bearing lubrication system, there may be no forced circulation and filtration, and circulation may be achieved through natural convection and gravity. FIG. 3 shows an example embodiment of such a bearing lubrication system 2200. The bearing lubrication system 2200 may include a sump 2210 connected to a riser 2220, which connects to reservoir 2230. Lubricant flows between the riser 2220 and bearings.

Figure 4:
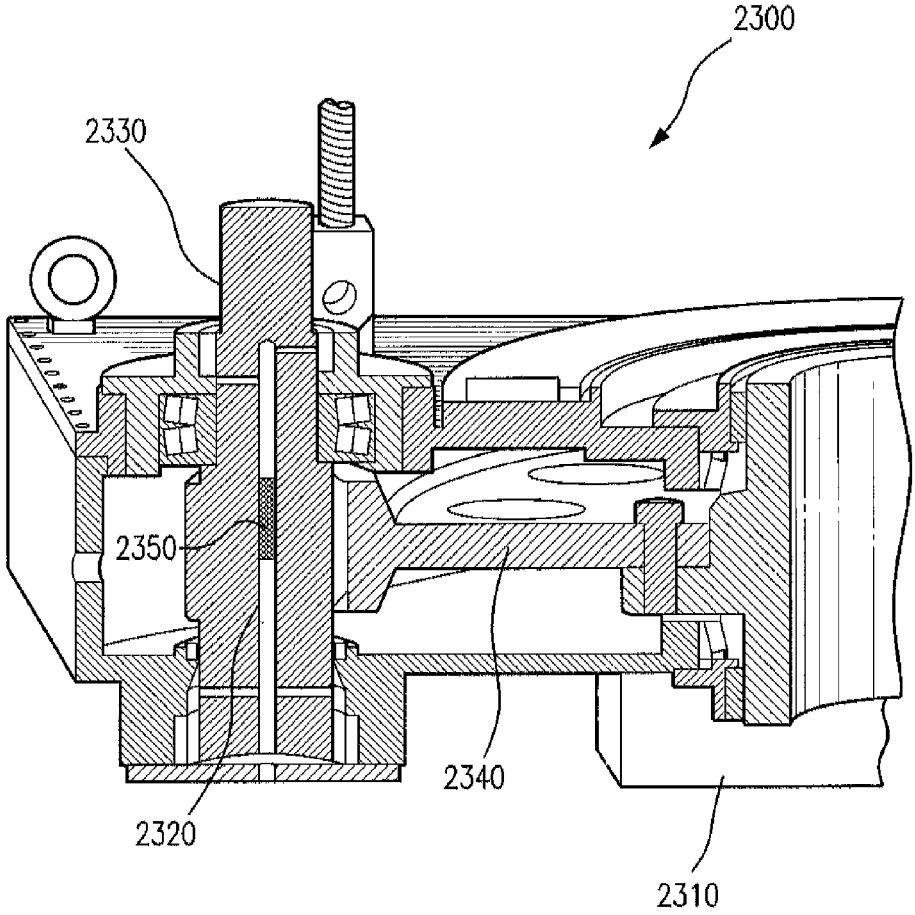
FIG. 4 is a partially cut away perspective view of one embodiment of a gearbox lubrication system.

In the gearbox lubrication system, the wear components from the gear that contaminate the lubricant generally require forced circulation and filtration. FIG. 4 shows an example embodiment of such a gearbox lubrication system 2300. The gearbox lubrication system 2300 may have an oil sump 2310, an oil passage 2320, one or more circulators (not shown) and one or more filters 2350, which serve to lubricate a contact surface between an input pinion 2330 and a bull gear 2340. Where a plurality of circulators and/or filters are used, they may be configured to create redundancy in the system.

In embodiments with an interchangeable washpipe, the washpipe may be changed very quickly so that the downtime is minimized. The change may be done remotely with automatic quick change capability.

The interchangeability of the various top drive modules may allow for repairs, maintenance, inspection, and/or operational reconfiguration to be performed off the critical path. This may reduce downtime for a modular top drive system, which corresponds to a reduced downtime for the entire rig. Some or all of the top drive modules may be symmetrical, allowing for installation in more than one location on the top drive.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, the present invention may be used to run drill pipe, as well as casing, or other tubulars. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A top drive system comprising:

a top drive;

a gearbox module fluidly coupled to an independent gearbox lubrication system of the top drive system; and at least one bearing lubricated by a bearing lubrication system fluidly coupled to the at least one bearing, wherein the bearing lubrication system is separate from at least the gearbox lubrication system so as to prevent any wear debris in the gearbox and gearbox lubrication system from interacting with the at least one bearing and the bearing lubrication system; and wherein the bearing lubrication system convectively circulates lubricant.

2. The top drive system of claim 1, wherein the top drive has a modular self contained lubrication system.

3. The top drive system of claim 1, wherein the bearing lubrication system convectively circulates lubricant naturally.

4. The top drive system of claim 1, wherein the gearbox lubrication system comprises a filter.

5. The top drive system of claim 1, wherein the gearbox lubrication system circulates lubricant via a pumping system.

6. The top drive system of claim 1, wherein the gearbox module is replaced with a replacement gearbox module that is off a critical path.

7. The top drive system of claim 6, wherein the gearbox module is configured to connect to the top drive through a splined connection and one or more fasteners.

8. The top drive system of claim 1, wherein the gearbox module comprises one or more of the following: a one-speed gearbox; a multi-speed gearbox; one or more input shafts for each of one or more coupled drive motors; one or more torque keys or quick latch assemblies to facilitate removal and installation; and a splined bull gear to transmit torque to the spindle.

9. The drive system of claim 8, wherein the gearbox module comprises a one-speed gearbox that has a reduction ratio range from about 6.89:1 to 9:1.

10. The top drive system of claim 1, wherein the gearbox lubrication system comprises at least one of the following: a dry sump reservoir; a suction strainer; one or more screw pumps and one or more electric motors; one or more filters; a distribution manifold; a sensor for sensing oil pressure; and a lube oil cooler.

11. A top drive system, comprising:

a top drive including at least one bearing; and a bearing lubrication system fluidly coupled to the at least one bearing, wherein the bearing lubrication system lubricates the at least one bearing through convective circulation and gravity in the absence of forced circulation.

12. The top drive system of 11, wherein the bearing lubrication system circulates unfiltered lubricant.

13. The top drive system of claim 11, wherein the bearing lubrication system is fluidly isolated from any other lubrication system associated with the top drive.

14. A method for minimizing bearing replacement in a top drive which comprises:

convectively circulating filtered lubricant in at least a gearbox module of the top drive to provide lubrication thereto; and separately convectively circulating a second lubricant in association with at least one bearing in the top drive, whereby the filtered lubricant and the second lubricant are isolated to minimize contact between wear debris from any module including at least the gearbox module and the at least one bearing.

15. The method of claim 14, wherein the second lubricant is the same as the first lubricant.

16. The method of claim 14, wherein the second lubricant is naturally convectively circulated.

17. A top drive system comprising a top drive; and a retract system interface frame module which comprises a connection configuration that mates with a variety of retract systems so as to make the retract system interface frame module interchangeable with an off critical path replacement retract system interface frame module.

18. The top drive system of claim 17, wherein the retract system interface frame module comprises at least one of an auto lubrication system, a junction box, a cooling system module, blowers for motor cooling, a programmable logic control, or a lubrication filtration system.

19. The top drive system of claim 17, wherein the retract system interface frame module is configured to move away from a second module of the top drive to facilitate access to the second module.

20. The top drive system of claim 19, wherein the retract system interface frame module rotates away from the second module.

21. The top drive system of claim 17, wherein the retract system interface frame module comprises a connection configuration in association with a plurality of guides to facilitate interchange of a pair of one or more alternate top drive modules associated with the top drive.

* * * * *